United States Patent [19]

Fukuchi et al.

[11] Patent Number: 4,588,279

[45] Date of Patent: May 13, 1986

[54] CLEANING ROLLER INTERMEDIATE TRANSFER MEMBER

[75] Inventors: Masakazu Fukuchi, Hachioji; Kiyoshi Kimura, Iruma; Noriyoshi Tarumi, Hachioji; Tadashi Miwa, Kunitachi; Yukio Okamoto, Hachioji; Kunio Ito, Tama, all of Japan

[73] Assignee: Konishiroku Photo Industry Co., Ltd., Tokyo, Japan

[21] Appl. No.: 544,965

[22] Filed: Oct. 24, 1983

[30] Foreign Application Priority Data

| | | | |
|---|---|---|---|
| Oct. 27, 1982 | [JP] | Japan | 57-187504 |
| Nov. 11, 1982 | [JP] | Japan | 57-196799 |
| Nov. 12, 1982 | [JP] | Japan | 57-197636 |
| Nov. 12, 1982 | [JP] | Japan | 57-197637 |

[51] Int. Cl.[4] ..... G03G 15/00

[52] U.S. Cl. ..... 355/3 TR; 355/3 FU; 355/15

[58] Field of Search ..... 355/15, 3 TR, 14 TR, 355/3 FU; 118/652, 104; 15/1.5 R, 256.51, 256.52; 430/125, 126; 219/216

[56] References Cited

U.S. PATENT DOCUMENTS

| | | | |
|---|---|---|---|
| 3,649,992 | 3/1972 | Thettu | 15/256.52 |
| 3,861,860 | 1/1975 | Thettu | 355/15 X |
| 3,868,744 | 3/1975 | Thettu | 15/256.52 |
| 3,878,818 | 4/1975 | Thettu et al. | 118/104 X |
| 3,980,424 | 9/1976 | Latone | 355/15 X |
| 4,341,455 | 7/1982 | Fedder | 355/3 FU X |
| 4,439,462 | 3/1984 | Tarumi et al. | 430/126 X |

FOREIGN PATENT DOCUMENTS

| | | | |
|---|---|---|---|
| 56-133769 | 10/1981 | Japan | 355/3 FU |
| 0153357 | 11/1981 | Japan | 355/15 |
| 56-161569 | 12/1981 | Japan | 355/14 TR |
| 0004081 | 9/1982 | Japan | 355/15 |

*Primary Examiner*—Arthur T. Grimley
*Assistant Examiner*—J. Pendegrass
*Attorney, Agent, or Firm*—James E. Nilles

[57] ABSTRACT

A cleaning member for an intermediate transfer member of a reproducing apparatus for transferring a toner image formed on a toner image forming member to the intermediate transfer member and further transferring the toner image to a subsequent transfer material from the intermediate transfer member, wherein the cleaning member has an outer layer of a porous or fibrous substrate and an outer surface of the toner, a resin identical with the toner or a resin compatible with the resin, or the cleaning member has an outer layer of adiabatic elastic material and a thin metallic outer surface layer.

4 Claims, 6 Drawing Figures

CLEANING ROLLER INTERMEDIATE TRANSFER MEMBER

BACKGROUND OF THE INVENTION

1. Field of the Invention

This invention relates to the improvement of a cleaning roller for an intermediate transfer member and a cleaning method therefor, and particularly to the improvement of a cleaning member used in contact with an intermediate transfer member of a reproducing apparatus which operates for transferring a toner image formed on a toner image forming member to the intermediate transfer member and further transferring the toner image to a subsequent transfer material from the intermediate transfer member for fixaction and of a cleaning method therefor.

2. Description of the Prior Art

An intermediate transfer member of a reproducing apparatus has an elastic material layer such as silicone rubber and fluororubber on the surface as a transfer layer, and a cleaning method of such intermediate transfer member by means of a blade or a heat resisting cloth is not enough to obtain a satisfactory effect of cleaning unlike that for a toner image forming member and a fixation press roller with the surface which is high in hardness and formed smoothly, and is liable to damage the transfer surface of the intermediate transfer member. A cleaning method for the intermediate transfer member which utilizes the property that a adhering strength of the toner to metal is more powerful than that to the transfer layer of silicone rubber or the like is known according to U.S. Pat. No. 3,649,992. The method comprises cleaning the intermediate transfer member by rotating a metallic cylinder in contact with the intermediate transfer member. However, it is not satisfactory to obtain a sufficient cleaning effect and has a problem of wearing down the transfer surface in most cases. More specifically, since the toner remains a little on an intermediate transfer layer, a cleaning action of the metallic cylinder does not deteriorate within a very short time. Still, however, as a toner adhesion quantity to the metallic cylinder increases, the toner adhesion quantity does not become uniform normally in the direction of a rotation axis of the metallic cylinder and thus a ruggedness is produced thereon. Therefore an adhesion of the metallic cylinder to the surface of the intermediate transfer member deteriorates, and thus the cleaning action becomes dull in consequence.

It is also known that a metallic cylinder is used as a cleaning roller for fixation press roller which brings a recording paper into pressure contact with the intermediate transfer member according to Japanese Utility Model Laid-Open No. 91546/1975. These methods utilize the property that the adhering strength of the toner to metal is more powerful than that to silicone rubber, fluororubber, fluororesin or the like provided on the surface of the intermediate transfer member and fixation press roller at a specific temperature range. However, if the cleaning roller is a mere metallic cylinder or metallic roller, the surface is too hard to fit on the intermediate transfer member or the fixation press roller, and a thermal capacity is too large to allow the temperature to rise easily, thus causing a problem on obtaining a satisfactory cleaning effect.

On the other hand, there is known a reproducing apparatus which forms a toner image and transfers it onto a recording paper at the first revolution of a toner image forming member by means of a magnetic brush device and then cleans the toner image forming member at the second revolution by means of the common magnetic brush. However, the method by means of the magnetic brush device commonly working for development and cleaning is available for an electrostatic reproducing apparatus using a two-component developer consisting of a toner and a magnetic carrier, but the toner image forming member tends to be stained by toner and fogged accordingly.

SUMMARY OF THE INVENTION

An object of this invention is to provide a cleaning member for an intermediate transfer member which is effective to clean the intermediate transfer member thoroughly without wearing a transfer surface.

The above object of this invention can be achieved by a cleaning member with an outer layer consisting of a porous or fibrous substrate on which outer surface toner or resin identical with the toner or another resin compatible with the above resin is present.

The above object of this invention can further be achieved by a cleaning roller in which an adiabatic material layer is provided on the outside of a roll core and a metallic thin layer is provided further on the outside of the adiabatic material layer.

According to the cleaning roller of this invention, the surface temperature can easily be raised to improve the cleaning effect, and the adiabatic material layer arranged in a sponge layer of heat resisting rubber can bring better fitting to the intermediate transfer member to have cleaning effect.

Another object of this invention is to provide a reproducing apparatus using an intermediate transfer member, wherein no cleaning apparatus has to be provided on a toner image forming member, and, if the cleaning apparatus is particularly provided, the surface of the toner image forming member is hardly worn out by weakening the cleaning action.

The above object of this invention can be achieved by a reproducing apparatus which operates for forming a toner image and transferring it to the intermediate transfer member at the first revolution of the toner image forming member and for cleaning the toner image forming member by the intermediate transfer member at the second revolution.

Further object of this invention is to obtain a cleaning method for removing a residual toner on the intermediate transfer member by utilizing the difference in adhering strength.

Further object of this invention is to provide a cleaning method wherein a cleaning member rotating in contact with the intermediate transfer member to remove a residual toner on the intermediate transfer member is prevented from deteriorating in cleaning action due to a toner adhesion.

The above object of this invention can be achieved by a cleaning method for the intermediate transfer member in a reproducing apparatus which operates for forming a toner image on a toner image forming member, transferring it to the intermediate transfer member, and further transferring it to a recording paper irom the intermediate transfer member to fixation, which comprises providing a cleaning member rotating in contact with the intermediate transfer member while the intermediate transfer member rotates from a further transferring position to a transferred position so as to have a residual toner sticked thereon, scraping the toner sticking on the cleaning member with a blade at a stage in which it is substantially hardnened.

Other objects and features of this invention will be understood along the following description and the drawings.

DESCRIPTION OF THE PREFERRED EMBODIMENTS

Figure 1:
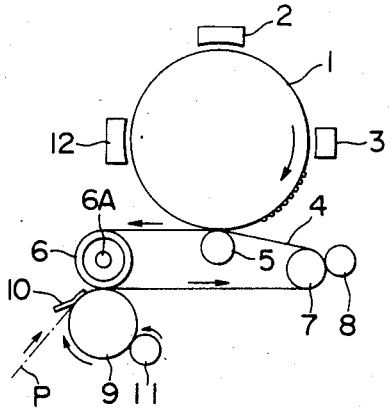
FIG. 1 and FIG. 2 are side views of a reproducing apparatus to which this invention pertains.

In FIG. 1, 1 denotes a drum-type toner image forming member rotating in a direction indicated by an arrow, 2 denotes a latent image forming mechanism, 3 denotes a dry type developing mechanism, 4 denotes a belt-type intermediate transfer member, 5 denotes a transfer press roller, 6 denotes a heating roller incorporating therein a heat source 6A such as infrared lamp and resistance heating unit, 7 denotes a tension roller, 8 denotes a cleaning roller for the intermediate transfer member 4, 9 denotes a fixation press roller, 10 denotes a heater working as a recording paper guide as well, 11 denotes a cleaning roller for the fixation press roller 9, and 12 denotes a cleaning mechanism for the toner image forming member 1. In case that the reproducing apparatus operates electrophotographically, the toner image forming member 1 is that with a photosensitive member provided on the surface, and the latent image forming mechanism 2 is that of having a charging system for charging the surface of the photosensitive member uniformly and an exposing system for projecting an original picture image to the charged surface. When the reproducing apparatus operates on electrostatic recording process, the toner image forming member 1 is that with a dielectric consisting of a conductive substrate and a dielectric surface layer provided on the surface, and the latent image forming mechanism 2 is that of having a multi-stylus electrode for forming an electrostatic latent image on the dielectric surface according to a picture signal or an ion control electrode. Further, when it operates on magnetic recording process, the toner image forming member 1 is that with a magnetic substance provided on the surface, and the latent image forming mechanism 2 is that of having a magnetizing head for forming a magnetic latent image on the magnetic substance surface according to a picture image. Then, when the latent image formed on the toner image forming member 1 as above is an electrostatic latent image, the dry type developing mechanism 3 is that for charging a toner to a polarity opposite to a charge of the electrostatic latent image and then supplying it to the surface of the toner image forming member 1. The cleaning mechanism 12 is that of having a discharging system for the surface of the toner image forming member 1 and a removing system for a residual toner. When the latent image is a magnetic latent image, the dry type developing mechanism 3 is that of supplying a magnetic toner to the surface of the toner image forming member 1, and the cleaning mechanism 12 is that of having a demagnetizing head for the surface of the toner image forming member 1 and a removing system for a residual toner. Such constitutions according to the difference in recording process are well known. Then, the intermediate transfer member 4 is formed of a laminate of a transfer layer consisting of a heat resisting elastic material such as silicone rubber and fluororubber and a substrate consisting of stainless steel sheet or heat resisting resin film such as polyimide, polyimideamide, aromatic polyamide, polyarylate and polyester, and particularly low temperature vulcanizing or room temperature vulcanizing silicone rubber is preferable because of being superior in a transfer efficiency from the toner image forming member 1 and a retransferring efficiency to a recording paper P. Examples of these intermediate transfer members are described in Japanese patent publication Nos. 41679/1971 and 22763/1973; Japanese patent publication Open to Public Inspection Nos. 78559/1974, 8569/1982, 27975/1982, 83876/1983, 85464/1983; U.S. Pat. No. 3,993,825 and the like.

Figure 2:
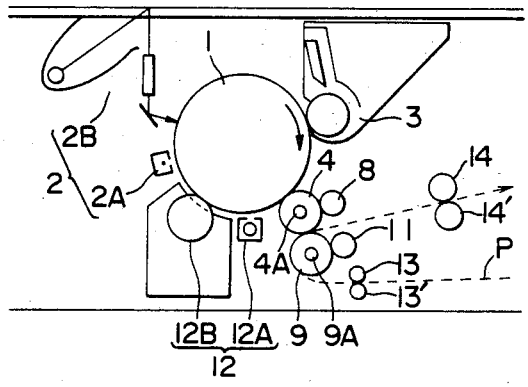

FIG. 2 represents an example of the reproducing apparatus in an electrophotographic reproducing machine. A charging system 2A and a exposing system 2B constitute the latent image forming mechanism 2, and a discharging system 12A using a halogen lamp or the like and a toner removing system 12B consitute the cleaning mechanism 12. The intermediate transfer member 4 is formed in a roller type, and the fixation press roller 9 is constituted so that the heater 10 in FIG. 1 can be omitted by providing a heat source 9A therein. The intermediate transfer member 4 comprises a transfer layer of silicone rubber or the like on the circumference of a metallic substrate of aluminum or the like with a heat source 4A provided therein. Then, 13, 13' denote feed rollers of the recording paper P, 14, 14' denote delivery rollers of the recording paper P with a toner image fixed thereon, and other like numerals as FIG. 1 represent the members of identical function.

In the reproducing apparatus using the intermediate transfer member 4 as described above, a toner image formed on the surface of the toner image forming member 1, from which a residual toner has been removed by the cleaning mechanism 12, by the latent image forming mechanism 2 and the dry type developing mechanism 3 is transferred efficiently to the intermediate transfer member 4, and the transferred toner image is further transferred to the recording paper P to fixation. However, some of the toner sticks and remains on the intermediate transfer member 4, and the toner sticking on the intermediate transfer member 4 is taken on the fixation press roller 9 while the recording paper P is not fed thereto. Therefore the cleaning rollers 8, 11 are used for the intermediate transfer member 4 and the fixation press roller 9.

In the embodiment of this invention, the cleaning roller 8 for the intermediate transfer member 4 uses a structure such that the outer layer thereof consists of a porous or fibrous substrate and the outer surface covered by the toner itself or a resin identical with the toner or another resin compatible with the toner resin.

These resins are preferably thermoplastic resins such as styrene type polymer, for example, polystyrene, polyvinyltoluene, styrene-butadiene copolymer, styrene-acrylic acid copolymer or styrene-maleic acid anhydride copolymer, polyester resin, acrylic resin, epoxy resin, xylene resin, ionomer resin, ketone resin, terpene resin, phenol denaturated terpene resin, rosin, rosin denaturated resin, maleic acid denaturated phenol resin, petroleum resin, starch graft polymer, polyvinyl alcohol and polyvinyl pyrolidone. These resins can be used alone or in combination as the resin compatible with the resin identical with the toner, above resins can be used. To decide the resin compatibility, it is a useful method to compare the solubility parameter $\delta$ of each resin. Solubility parameter $\delta$ is well known in the polymer science, for example as described in Journal of Applied Polymer Science, Vol. 12, by W. A. Lee, J. H. Sewell. If $\Delta\delta$ is less than 2, these resins are preferably used in the invention, but the value $\Delta\delta$ is not a essential parameter in the invention.

In the above resins, styrene type polymer, acrylic polymer and styrene-acrylic polymer are preferably used. As monomers of styrene type polymer, styrene, o-methylstyrene, m-methylstyrene, p-methylstyrene, $\alpha$-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and the like are used.

As monomers of acrylic polymer, $\alpha$-methyleneali-phatic monocarboxylic acid ester such as methylacrylate, ethylacrylate, n-butylacrylate, isobutylacrylate, propylacrylate, n-octylacrylate, dodecylacrylate, laurylacrylate, 2-ethylhexylacrylate, stearylacrylate, 2-chloroethylacrylate, phenylacrylate, $\alpha$-chloromethylacrylate, methylmethacrylate, ethyl-methacrylate, propylmethacrylate, n-butylmethacrylate, isobutylmethacrylate, n-octylmethacrylate, dodecylmethacrylate, lauryl-methacrylate, 2-ethyl-hexylmethacrylate, stearyl-methacrylate, phenyl-methacrylate, dimethylaminoethyl-methacrylate, diethylaminoethyl-methacrylate; and acrylic or methacrylic acid derivatives such as acrylonitrile, methacrylonitrile and acrylamide are used. As styrene-acrylic polymer, copolymers of styrene monomer and acrylic monomer are used.

Figure 3:
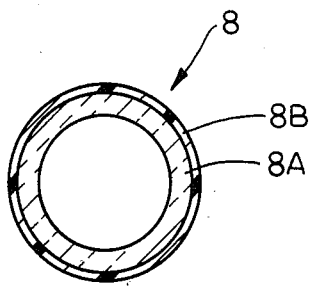
FIG. 3 is a sectional view of a cleaning roller of this invention.

FIG. 3 represents an example of such cleaning roller 8. The cleaning roller 8 is formed by sticking a resin identical with the toner or another resin compatible therewith on the circumference of a paper tube 8A by impregnation or coating so as to form a thin resin layer 8B. The toner on the intermediate transfer member 4 which is heated by the heating roller 6 and the heater 10 or the heat source 4A and the heat source 9A of the fixation press roller 9 and thus softened somewhat is taken very efficiently on the resin layer 8B of the cleaning roller 8, thus obtaining an exceedingly superior cleaning effect. It is then conceivable that the effect is obtained by the circumstances that the cleaning roller 8 is easily transformed in contact with the intermediate transfer member 8 to form a contact width and to obtain a sufficient thermal conduction from the intermediate transfer member, and since heat transferred from the intermediate transfer member effects only the instant rise of the temperature of the roller surface because of low thermal conductivity of the substrate due to its adiabatic characteristics, the toner or the resin of the cleaning roller can contact with the toner remaining on the intermediate transfer member 4 and that the toner taken on the cleaning roller 8 may easily be solid with the resin layer 8B of the cleaning roller 8 and further show an inclination to get into the paper tube 8A. Consequently, the cleaning roller 8 of this invention contains many features that the cleaning efficiency will not deteriorate for a considerably long period of time, the surface of the intermediate transfer member 4 will hardly be worn out, and that it is ready for replacement from its being obtainable at a moderate cost. Then, it is preferable that the cleaning roller of this invention be arranged to rotate according to the intermediate transfer member.

For the cleaning roller of this invention, the substrate is not limited to paper tube, but a convenient material such as, for example, sponge rubber or polyamide felt consisting of a porous resin can be employed on a metallic roll. Other examples of the substrate are porous heat resisting resin of polyimide, polyphenylsulfide, epoxy, polyamideimide and the like, heat resisting felt or aromatic polyamide fiber such as Nomex paper manufactured by E. I. Dupont and heat resisting insulating paper ABR 24 manufactured by Japan Aroma Co., Ltd. The substrate preferably have a thermal conductivity of $10^{-4}$–$10^{-5}$ cal/cm.C.Sec. The method for forming a porous resin are well known in the art; for example, mixing soluble metallic salts in resins and forming foams by thereafter removing these metallic salts or using forming agents. The cleaning roller of this invention can be used for cleaning the fixation press roller with a layer of silicone rubber, fluororubber or fluororesin provided on the surface. In this invention, the cleaning member can be a belt-type or web type as well as a roller type.

Figure 4:
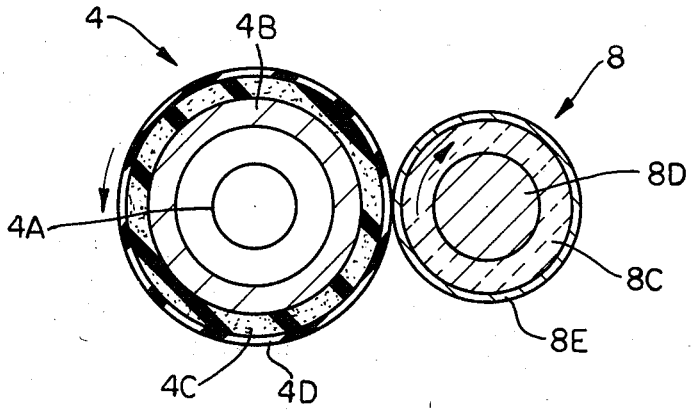
FIG. 4 is a sectional view of an intermediate ransfer member and a cleaning roller in another embodiment of this invention.

In another embodiment of this invention, the intermediate transfer member 4 of a reproducing machine has a construction, as shown in FIG. 4, wherein an elastic layer 4C of silicone rubber or the like is provided on the outside of a core 4B consisting of a metal such as aluminum which is provided with the heat source 4A therein, and a transfer layer 4D consisting of silicone rubber, fluororubber or the like is provided on the outside of the elastic layer 4C. The cleaning roller 8 for the intermediate transfer member 4 has a construction wherein an adiabatic elastic material layer 8C of silicone rubber or the like is provided on the outside of a roller core 8D consisting of a metal of aluminum or the like, and a metallic thin layer 8E of nickel or the like having thickness of 500$\mu$ or below or preferably 50 to 200$\mu$ is provided on the outside thereof.

When such intermediate transfer member 4 and cleaning roller 8 are used, a toner image on the drum-type toner image forming member 1 is transferred efficiently to the intermediate transfer member 4 and further transferred to the recording paper P efficiently to fixation. The toner remaining on the intermediate transfer member 4 without being taken on the recording paper P and the fixation press roller 9 is taken efficiently on the surface of the metallic thin layer 8E of the cleaning roller 8 coming in good contact with the surface of the intermediate transfer member 4 and subjecting to a temperature rise. It is therefore preferable that LTV- or RTV-type silicone rubber be used for the transfer layer 4D of the intermediate transfer member 4 and that a metallic ring formed through electroforming be used for the metallic thin layer of the cleaning roller 8. The reason is because the metallic ring according to electroforming process can easily be formed thin and smoothly for the surface.

According to the embodiment of this invention, an effect is obtainable so that the intermediate transfer member can be cleaned efficiently without providing a heating means particularly on the cleaning roller. Then, the toner taken on the cleaning roller can be removed by providing a removing means such as scraper blade on the cleaning roller. However, the toner sticking on the intermediate transfer member is normally not much, therefore a replacement of the cleaning roller can be available enough to remove the toner.

This invention can be applied not only to a roller-type intermediate transfer member but also to a belt-type one, and further it can be applied not only to a reproducing apparatus working on electrophotography but also to that of working on electrostatic recording or magnetic recording.

Figure 6:
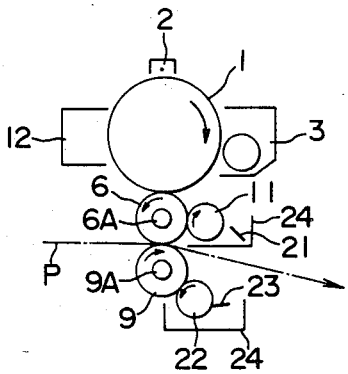

In further embodiment of this invention, charging, exposing, toner developing and transfer to the intermediate transfer member are carried out at the first revolution of the toner image forming member 1. Therefore in FIGS. 1 and 2, the surface of the toner image forming member 1 is cleaned by the intermediate transfer member 4 at the second revolution of the toner image forming member 1. The toner sticking on the intermediate transfer member 4 is taken on the fixation press roller 9 during the cleaning under the state wherein the recording paper P is not fed thereto and is further removed from the fixation press roller 9 by the cleaning apparatus 11. This cleaning apparatus 11 can further comprise a cleaning blade for cleaning off the toner on the fixation press roller 9 so as not to damage the surface of the roller 9, as shown in FIG. 6 as a blade member 23. Consequently, the cleaning apparatus need not be provided on the toner image forming member 1, wear of the photosensitive material is decreased, and the toner image forming member 1 can be miniaturized to obtain the reproducing apparatus compactly and cheaply. Further, if the cleaning apparatus is provided on the toner image iorming member 1 for precaution, wear of the photosensitive material can also be decreased because the cleaning action can be weakened.

In this invention, as a developer, one-component toner as well as two-component developer can be used. And a plain paper can be used as a recording paper even in the use of one-component conductive magnetic toner. In case of insulating toner having a resistivity of more than $10^{10}\Omega$ cm, recording by retention process can be used. Further, in order to release cleaning load by the intermediate transfer member and prevent the adhesion of toner onto the image forming member from the developing device, electric charge eliminating treatment by exposure and the like can be applied to the image forming member in the second revolution of the image forming member after transfer of the toner image onto the intermediate transfer member. In the second revolution, when the cleaning device is used commonly as the cleaning device as being known in the art, cleaning operation by means of the developing device and the intermediate transfer member can be used to improve cleaning effect.

Figure 5:
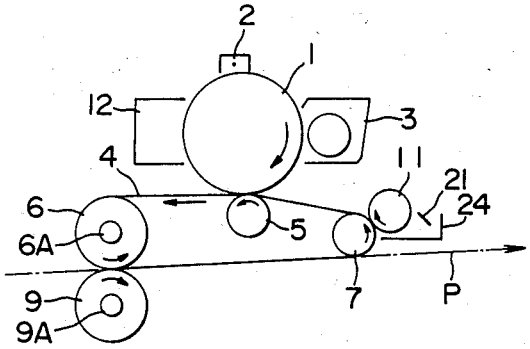
FIG. 5 and FIG. 6 are side views of a reproducing apparatus of another embodiments of this invention.

In further embodiment of this invention, the cleaning member 11 is capable of rotating in contact, as illustrated in FIG. 5, with the intermediate transfer member 4 or in contact with the blade 21 apart from the intermediate transfer member 4. Therefore, the cleaning member 11 is kept in contact with the intermediate transfer member 4 for cleaning, and when the toner deposits on the cleaning member 11 to deteriorate the cleaning action, the cleaning member 11 is detached from the intermediate transfer member 4. Then the cleaning member 11 is kept in contact with the blade 21 at the stage wherein the deposited toner is essentially hardened, thus scraping down the toner deposited on the cleaning member 11 effectively. The cleaning member 11 is prevented from deteriorating in cleaning action, and the intermediate transfer member 4 can be cleaned efficiently by the cleaning member 11 at all times. Then, the cleaning member 11 can be kept in contact with the blade 21 immediately after it is detached from the intermediate transfer member 4 before the deposited toner is hardened. In this case, the deposited toner can be scraped down effectively as hardened. The toner deposited on the cleaning member 11 is scraped down at a driving stage in which the toner image is never transferred from the toner image forming member 1 to the intermediate transfer member 4 or at a quiescent stage in which the reproducing apparatus does not operate for recording. On the other hand, as will be described hereinafter, the cleaning member 11 of belt-type may have the toner sticking thereon removed as cleaning the intermediate transfer member 4.

The cleaning member 11 is not necessarily limited to metal in material and a heat resisting elastic material layer of silicone rubber or the like or a heat resisting resin layer of polyimide, aromatic polyamide or the like will be acceptable for the constitution subject to the surface being greater in adhering strength of toner than the transfer layer of the intermediate transfer member 4. In this invention, the cleaning members shown in FIGS. 3 and 4 are preferably used. Further, it is not necessarily limited to a roller type, and a belt-type may be employed therefor. When the belt-type one is employed for the cleaning member 11, the toner may take a sufficient time for hardening essentially before it reaches a position whereat the blade 21 comes in contact therewith. Therefore the toner sticking on the cleaning member 11 can be removed by the blade 21 with the cleaning member 11 kept in contact with the intermediate transfer member 4 for cleaning action.

For easy sticking of the toner from the intermediate transfer member 4 to the cleaning member 11, a heat source can be provided in the cleaning member 11, or the surface of the cleaning member 11 can be heated from outside. For removing the toner deposited on the cleaning member 11 in this case, the heating may be stopped. A metallic plate like stainless steel or a resin plate is used for the blade 21.

The cleaning means for the intermediate transfer member 4 as described above can be employed for the fixation press roller 9, and FIG. 6 represents a case where a cleaning member 22, a blade 23 and an enclosing box 24 are employed for the fixation press roller 9 as in the case of the intermediate transfer member 4.

What is claimed is:

1. Reproducing apparatus comprising:

a toner image forming member;

transfer material;

a rotatable intermediate transfer member for transferring a toner image from said toner image forming member at a first transfer position to said transfer material at a second transfer position;

means for heating said intermediate transfer member;

and cleaning means for cleaning toner remaining on said intermediate transfer member after said second transfer position, said cleaning means comprising a cleaning roller for contacting and cleaning said residual toner from said intermediate transfer member and having an outer layer comprising an adiabatic porous substrate for retaining heat transferred to said outer layer from said intermediate transfer member and an outer surface layer on the outer surface of said adiabatic porous substrate, said outer surface layer comprising a thin metallic member comprising nickel.

2. Reproducing apparatus according to claim 1 wherein said thin metallic member has a thickness in a range between about 50 to 500μ.

3. Reproducing apparatus according to claim 1 or 2 further comprising a cleaning blade for removing toner remaining on said cleaning roller after said last-recited toner has substantially hardened.

4. Reproducing apparatus according to claim 3 further comprising means to cause said cleaning blade to be disengaged from said cleaning roller when said cleaning roller rotates in contact with said intermediate transfer member during image transfer and to be engaged with said cleaning roller when said intermediate transfer member is not performing image transfer.

* * * * *